United States Patent [19]

deMauriac

[11] 4,220,709

[45] Sep. 2, 1980

[54] HEAT DEVELOPABLE IMAGING MATERIALS AND PROCESS

[75] Inventor: Richard A. deMauriac, Webster, N.Y.

[73] Assignee: Eastman Kodak Company, Rochester, N.Y.

[21] Appl. No.: 858,876

[22] Filed: Dec. 8, 1977

Related U.S. Application Data

[63] Continuation of Ser. No. 684,699, May 10, 1976, abandoned.

[51] Int. Cl.[2] ..... G03C 5/30; G03C 1/02

[52] U.S. Cl. ..... 430/353; 430/619; 430/620

[58] Field of Search ..... 96/114.1, 48 PD, 48 HD, 96/66 T, 114.6, 67, 94 R, 76, 95

[56] References Cited

U.S. PATENT DOCUMENTS

| | | | |
|---|---|---|---|
| 2,353,754 | 11/1942 | Peterson | 96/94 R |
| 3,438,776 | 4/1969 | Yudelson | 96/95 |
| 3,457,075 | 7/1969 | Morgan et al. | 96/114.1 |
| 3,647,439 | 3/1972 | Bass | 96/114.6 |
| 3,666,477 | 5/1972 | Goffe | 96/114.1 |
| 3,672,904 | 6/1972 | deMauriac et al. | 96/114.1 |
| 3,689,270 | 9/1972 | Anderson | 96/76 |
| 3,761,270 | 9/1973 | deMauriac et al. | 96/114.1 |
| 3,767,414 | 10/1973 | Huffman et al. | 96/114.1 |
| 3,827,889 | 8/1974 | Ohkubo et al. | 96/114.1 |
| 3,832,186 | 8/1974 | Masuda et al. | 96/114.1 |
| 3,933,507 | 1/1976 | Von Konig et al. | 96/114.1 |
| 4,028,129 | 6/1977 | Suzuki et al. | 96/114.1 |

FOREIGN PATENT DOCUMENTS

| | | | |
|---|---|---|---|
| 1453635 | 8/1966 | France | 96/48 R |
| 1205500 | 9/1970 | United Kingdom | 96/114.1 |
| 1389501 | 4/1975 | United Kingdom | 96/114.1 |

OTHER PUBLICATIONS

Stabilization of Photographic AgX Emulsions, Birr Focal Press, N.Y., N.Y. ©1974 pp. 204–207.

*Primary Examiner*—J. Travis Brown
*Attorney, Agent, or Firm*—Richard E. Knapp

[57] ABSTRACT

A heat developable photographic material comprising in reactive association (a) photosensitive silver halide, (b) an image-forming combination comprising (i) a complex of silver with a nitrogen acid selected from the group consisting of imidazole, pyrazole, urazole, 1,2,4-triazole and 1H-tetrazole nitrogen acids or combinations thereof, with (ii) an organic reducing agent, and (c) a polymeric binder, provide developed images without the need for processing solutions or baths. An image can be developed in this heat developable material by merely heating the material to moderately elevated temperatures. Other addenda employed in heat developable materials can be employed with the heat developable photographic materials described.

41 Claims, No Drawings

HEAT DEVELOPABLE IMAGING MATERIALS AND PROCESS

This is a continuation of application Ser. No. 684,699, filed May 10, 1976, now abandoned.

BACKGROUND OF THE INVENTION

1. Field of the Invention

This invention relates to heat developable imaging materials and processes for developing an image employing in reactive association (a) photosensitive silver halide, (b) an image-forming combination comprising (i) certain complexes of silver with certain nitrogen acids with (ii) an organic reducing agent, and (c) a polymeric binder. In one of its aspects it relates to a heat developable photographic element comprising a support having thereon the described combination of materials. In another aspect it relates to a heat developable photographic composition comprising the described imaging combination. A further aspect of the invention relates to a process of developing an image in a heat developable photographic element containing the described imaging combination.

2. Description of the State of the Art

It is known to obtain an image in an imaging material, especially a photographic imaging material, by so-called dry processing with heat. These materials are sometimes described as heat developable photographic materials or photothermographic materials. Such heat developable photographic materials after imagewise exposure are heated to provide a developed image in the absence of separate processing solutions or baths. Typical heat developable imaging materials or photothermographic materials are described, for example, in U.S. Pat. No. 3,152,904 of Sorensen et al, issued Oct. 13, 1964; U.S. Pat. No. 3,457,075 of Morgan et al, issued July 22, 1969; U.S. Pat. No. 3,152,903 of Shepard et al, issued Oct. 13, 1964; U.S. Pat. No. 3,392,020 of Yutzy et al, issued July 9, 1968; and British Specification No. 1,161,777 published Aug. 20, 1969.

The most commonly employed silver salts in such heat developable photographic materials are silver salts of long-chain fatty acids, such as silver behenate. It has been desirable to replace such silver salts of long-chain fatty acids to enable use of aqueous or hydrophilic compositions which further enable the use of conventional silver halide technology in heat developable photographic materials. Use of silver behenate as a so-called source of silver in such heat developable materials is not particularly compatible with aqueous formulations of silver halide materials. Other silver salts or complexes have been proposed for such heat developable photographic materials. These include, for example, silver salts of benzotriazole, silver salts of saccharin and related silver salts or complexes. These are described, for example, in heat developable photographic materials and U.S. Pat. No. 3,617,289 of Ohkubo et al, issued Oct. 2, 1971; U.S. Pat. No. 3,666,477 of Goffe, issued May 30, 1972; U.S. Pat. No. 3,672,904 of deMauriac, issued June 27, 1972; U.S. Pat. No. 3,832,186 of Masuda et al, issued Aug. 27, 1974; British Specification No. 1,205,500 published Sept. 16, 1970; U.S. Pat. No. 3,689,270 of Anderson et al, issued Sept. 5, 1972; and German Offenlegungsschrift No. 2,326,865 published Dec. 6, 1973. While many of these silver complexes or salts can provide an image in such heat developable photographic materials, they often provide undesirable processing temperature latitude, undesired photographic speed, undesired image tone, or a combination of one or more of these problems.

It is desirable in many cases to spectrally sensitize heat developable photographic materials to enable exposure to exposure means containing other than the blue region of the visible spectrum. Difficulty is often encountered in spectrally sensitizing photosensitive silver halide to be used in heat developable materials. While in many cases some degree of spectral sensitization can be obtained, it is often insufficient for most photographic purposes. It has been desirable to provide a heat developable photographic material based on aqueous photographic silver halide technology which permits use of a broad range of spectral sensitizing dyes.

It has been desirable also to provide heat developable photographic materials which enable use of commonly employed silver halide developing agents in the photographic material. Heat developable photographic materials often have used unconventional reducing agents which require costly processes of preparation. It has been desirable to eliminate this problem with a heat developable photographic material which better enables use of conventional developing agents, such as hydroquinone developing agents and ascorbic acid developing agents. Typical reducing agents which have been used in heat developable photographic materials are described, for example, in U.S. Pat. No. 3,672,904 of deMauriac, issued June 27, 1972. Commercially available photothermographic materials have used such reducing agents as 2,2'-methylenebis (4-methyl-6-tertiary butyl phenol) which is not a conventional silver halide developing agent.

Photographic materials which are not heat developable photographic materials are known containing nitrogen acids. Nitrogen acids, for example, are described in photographic materials in Belgian Pat. No. 790,955 issued May 3, 1973 and U.S. Pat. No. 3,933,507 of von Konig et al, issued Jan. 20, 1976. Neither of these references, however, suggest answers to the described problems in heat developable photographic materials.

Heavy metal salts of azoles are also known in thermographic materials, that is materials in which the visible image is formed by imagewise heating, not by a photographic process. Such heavy metal salts of azoles are described, for example, in thermographic materials in U.S. Pat. No. 3,767,414 of Huffman et al, issued Oct. 23, 1973. The described thermographic materials, however, do not enable the advantages encountered with photosensitive materials.

Silver salts of a range of organic compounds are known for various purposes in photographic materials. Such uses of silver salts are described, for example, in U.S. Pat. No. 2,353,754 of Peterson, issued July 18, 1944; and U.S. Pat. No. 3,794,496 of Manhart, issued Feb. 26, 1974.

There has been a continuing need for heat developable photographic materials which have the degree of photosensitivity provided by a photographic silver halide material and which enable the use of conventional gelatino silver halide emulsion technology.

This need has been especially true for heat developable photographic materials which enable a processing temperature below about 170° C.

SUMMARY OF THE INVENTION

It has been found according to the invention that the described advantages can be provided in a heat developable photographic material comprising in reactive association (a) photosensitive silver halide, (b) an image-forming combination comprising (i) a complex of silver with a nitrogen acid selected from the group consisting of imidazole, pyrazole, urazole, 1,2,4-triazole and 1H-tetrazole nitrogen acids and combinations thereof, with (ii) an organic reducing agent and (c) a polymeric binder. Especially useful complexes of silver with a nitrogen acid as described are those complexes with 1,2,4-triazole and 1H-tetrazole nitrogen acids because these enable wider processing temperature latitude and provide higher speed photographic materials. An image in the described heat developable materials can be provided by merely heating the exposed material for several seconds at moderately elevated temperatures such as a temperature within the range of about 120° C. to about 180° C. No processing solutions or baths are required to provide a developed image.

DETAILED DESCRIPTION OF THE INVENTION

An important embodiment of the invention is a heat developable photographic element comprising a support having thereon in reactive association components (a), (b) and (c) as described. A range of complexes of silver with the described nitrogen acids are useful in the heat developable photographic materials. A nitrogen acid as described herein is intended to include those compounds which have the moiety —NH— in the heterocyclic nucleus. Especially useful complexes of silver with nitrogen acids are silver complexes of 1H-tetrazole nitrogen acids represented by the formula:

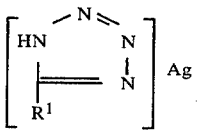

wherein $R^1$ is hydrogen, alkyl containing 1 to 20 carbon atoms, typically 1 to 5 carbon atoms, such as methyl, ethyl, propyl, butyl and pentyl, or $NH_2$. Examples of especially useful 1H-tetrazole nitrogen acids are:

1H-tetrazole,
dodecyltetrazole and
5-n-butyl-1H-tetrazole.

Other especially useful silver complexes of nitrogen acids are silver complexes of 1,2,4-triazole nitrogen acids represented by the formula:

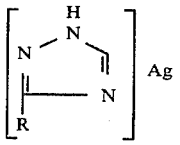

wherein R is hydrogen or $NH_2$. This includes silver complexes of 1,2,4-triazole and amino-1,2,4-triazole.

Other classes of useful complexes of silver with nitrogen acids include silver complexes of urazoles, pyrazoles and imidazoles. These classes, in some cases, are not as effective as the preferred classes of complexes of silver salts with nitrogen acids. A useful complex is a silver complex of a urazole nitrogen acid represented by the formula:

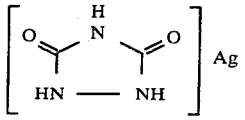

Another class of complex of silver with a nitrogen acid is a silver complex of pyrazole represented by the formula:

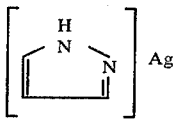

A further complex of silver with a nitrogen acid is a silver complex of an imidazole represented by the formula:

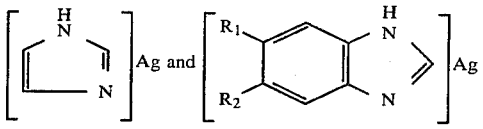

wherein $R_1$ is H, $CH_3$ or $NO_2$ and $R_2$ is H.

Combinations of the described complexes of silver with nitrogen acids are also useful. The optimum combination can be determined based on such factors as the desired image, other components in the heat developable photographic material, processing conditions, and the like.

Preparation of the described nitrogen acids can be carried out with procedures known in the art. Also, preparation of complexes of silver with the described nitrogen acids can be carried out using procedures known in the art. The complexes of silver with nitrogen acids can be prepared either in-situ, that is in combination with other components of the heat developable photographic materials, or ex-situ, that is separate from other components of the heat developable photographic materials. In most instances, the preparation will be separate from the other components of the photographic materials based on ease of control of preparation and storage capability. A complex of silver with 1,2,4-triazole and its preparation is described, for example, in *Chemical Abstracts,* Volume 21, page 3054 and *Chemical Abstracts,* Volume 52, page 1999. Preparation of the silver salt or complex of imidazole is described, for example, in *Chemical Abstracts,* Volume 52, page 1999 also. The preparation of a complex of silver with a nitrogen acid in many cases will merely involve mixing a source of silver ion, such as silver nitrate, with the desired nitrogen acid in a suitable solvent, such as an aqueous solvent. Purification of the resulting product can be carried out using methods known in the art. Another example of a preparation of a complex of silver with a nitrogen acid is the preparation of complexes of silver with 1H-tetrazoles, such as 5-methyl, 5-ethyl and 5-isopropyl derivatives of 1H-tetrazole, in the *Journal of Organic Chemistry,* Volume 15, beginning at page 1082 and the *Journal of Organic Chemistry,* Volume 18, beginning at page 1003.

The term "complex" as used herein is intended to include any type of bonding or complexing mechanism which enables the resulting material to provide imaging properties in the described image-forming combination. In some instances the exact bonding of the described complex of silver with a nitrogen acid is not fully understood. Accordingly, the term "complex" is intended to include salts and other forms of bonding which enable the desired image-forming combination to provide the desired image in the described heat developable photographic material. The term "complex" is intended to include what may have been known in the past as salts. The term "complex" is intended to include neutral complexes or non-neutral complexes.

An advantage of the described heat developable material and process of the invention is that aqueous formulations, such as aqueous gelatino photographic emulsions, are especially useful. The heat developable photographic materials according to the invention comprise a photosensitive component which is photosensitive silver halide. The photosensitive silver halide is especially useful due to its increased photosensitivity compared to other photographic components. A typical concentration of photosensitive silver halide in a heat developable photographic element according to the invention is within the range of about 0.05 to about 3 moles of photosensitive silver halide per mole of silver complex in the heat developable photographic material. For example, a typically preferred concentration range of photographic silver halide is about 0.1 to about 0.5 moles of photographic silver halide per mole of silver complex in the described heat developable photographic material. Other photographic materials can be used in combination with the described photosensitive silver halide if desired. For example, useful photosensitive silver salts can include silver dye complexes such as those described in U.S. Pat. No. 3,647,439 of Bass, issued Mar. 7, 1972. Preferred photographic silver halides are silver chloride, silver bromide, silver bromoiodide, silver chlorobromoiodide or mixtures thereof. For purposes of the invention, silver iodide is also considered to be a useful photographic silver halide. Very fine-grain photographic silver halide is useful although coarse- or fine-grain photographic silver halide can be employed if desired. The photographic silver halide can be prepared by any of the procedures known in the photographic art especially those procedures which involve the preparation of photographic silver halide gelatino emulsions. Useful procedures and forms of photographic silver halide for purposes of the invention are described, for example, in the *Product Licensing Index,* Volume 92, December, 1971, publication 9232 on page 107, paragraph I. The photographic silver halide as described can be unwashed or washed, can be chemically sensitized using chemical sensitization procedures known in the art, can be protected against production of fog and stabilized against loss of sensitivity during keeping as described in the above *Product Licensing Index* publication.

The described heat developable photographic materials can comprise a variety of reducing agents, especially organic reducing agents which are typical photographic silver halide developing agents. These reducing agents are organic reducing agents. Combinations of organic reducing agents, typically silver halide developing agents, can be useful. Reducing agents which are especially useful are silver halide developing agents including polyhydroxy benzenes, such as hydroquinone, alkyl-substituted hydroquinones, including tertiary-butyl hydroquinone, methylhydroquinone, 2,5-dimethylhydroquinone, and 2,6-dimethylhydroquinone; catechol and pyrrogallol developing agents; chloro-substituted hydroquinones such as chlorohydroquinone or dichlorohydroquinone; alkoxy-substituted hydroquinones such as methoxyhydroquinone or ethoxyhydroquinone; aminophenol reducing agents such as 2,4-diaminophenols and methylaminophenols; ascorbic acid developing agents such as ascorbic acid, ascorbic acid ketals and ascorbic acid derivatives; hydroxylamine reducing agents; 3-pyrazolidinone reducing agents such as 1-phenyl-3-pyrazlidinone and 4-methyl-4-hydroxymethyl-1-phenyl-3-pyrazolidinone; reductone reducing agents, such as 2-hydroxy-5-methyl-3-piperidino-2-cyclopentanone; gallic acid ester reducing agents such as methylgallate; sulfonamido phenol reducing agents such as the sulfonamidophenol reducing agents described in *Research Disclosure,* January 1973, pages 16–21; phenylenediamine silver halide developing agents such as paraphenylenediamine and the like. Especially useful heat developable photographic materials include those which contain an organic reducing agent selected from the group consisting of hydroquinone, ascorbic acid, pyrrogallol, gallic acid ester, and phenylenediamine silver halide developing agents and combinations thereof.

A useful concentration of organic reducing agent in a heat developable photographic material as described is typically within the range of about 0.1 moles to about 3 moles of organic reducing agent per mole of silver complex. An especially useful concentration of organic reducing agent is within the range of about 0.5 to about 1.5 moles of reducing agent per mole of silver complex. The optimum concentration of reducing agent can be determined based upon such factors as the desired image, other components in the heat developable photographic material, processing conditions and the like.

The heat developable photographic materials according to the invention can contain various colloids and polymers alone or in combination as vehicles, binding agents, and in various layers. Suitable materials as described are preferably hydrophilic materials although some hydrophobic materials can be useful. The colloids and polymers are transparent or translucent and include both naturally-occurring substances such as proteins, for example, gelatin, gelatin derivatives, cellulose derivatives, polysaccharides, such as dextran, and the like; and synthetic polymeric substances such as water soluble polyvinyl compounds like poly(vinyl pyrrolidone), acrylamide polymers and the like. Other synthetic polymeric compounds which can be employed include dispersed vinyl compounds such as in latex form and particularly those which increase dimensional stability of photographic materials. Effective polymers include high molecular weight materials, polymers and resins which are compatible with the described complex of silver with a nitrogen acid and other components of the heat developable photographic material. Especially useful materials include gelatin, poly(vinyl pyrrolidone), and poly(vinyl alcohol). Other useful polymeric materials as binders include:

(a) Copolymer of acrylamide and 1-vinylimidazole, 90:10 weight ratio.

(b) Copolymer of acrylamide and 2-acetoacetoxyethyl methacrylate, 98:2 weight ratio.

Combinations of the described colloids and polymers can also be used.

The heat developable photographic materials according to the invention can contain an image toner in order to provide a more neutral or black tone image upon processing. The optimum toning agent will depend upon such factors as the particular heat developable photographic material, the desired image, particular processing conditions and the like. In some cases certain image toning agents provide much better results with certain complexes of silver with nitrogen acids than with other silver salts. A simple screening test can be used to select a useful image toning agent. One such test comprises that described in following Example 13. The silver complex of the nitrogen acid in that example can be replaced with other complexes of silver salts with nitrogen acids to select the optimum image toning agent for the particular complex of silver with the nitrogen acid. In this test the most useful toning agent is typically that toning agent which provides a ratio of (a) visible maximum density to (b) blue light maximum density exceeding a value of 0.87. A variety of toning agents are also found to act as development accelerators producing up to a 1.0 log E speed increase in the photographic material. Especially useful toning agents are selected from the group consisting of 1,2,4-triazole, 1H-tetrazole, thiouracil and 1,3,4-thiadiazole toning agents. Examples of preferred toning agents are 5-amino-1,3,4-thiadiazole-2-thiol; 3-mercapto-1,2,4-triazole and bis(-dimethylcarbamyl) disulfide. Especially useful toning agents are those which provide a black tone image.

A range of concentration of toning agent is useful in a heat developable photographic material according to the invention. A typically useful concentration of toning agent is within the range of about 0.01 to about 0.1 moles of toning agent per mole of silver complex in the heat developable photographic material. The optimum concentration of toning agent will depend upon such factors as the particular heat developable photographic material, processing conditions, desired image and the like.

It is often useful to include a melt forming compound in the heat developable photographic materials according to the invention in order to provide an improved developed image. The term "melt-forming compound" as employed herein is intended to mean a compound which upon heating to the described processing temperature provides an improved reaction medium, typically a molten medium, within which the described image-forming combination can provide better image development. The exact nature of the reaction medium at processing temperatures described is not fully understood; however, it is believed that at the reaction temperatures a melt occurs which permits the reaction components to better interact. Useful melt-forming compounds are typically separate components from the image-forming combination, although the image-forming combination can enter into the melt formation. Typically useful melt forming compounds are amides, imides, cyclic ureas and triazoles which are compatible with the other components of the heat developable photographic materials. Useful melt-forming compounds are described, for example, in U.S. Pat. No. 3,438,776 of Yudelson issued Apr. 15, 1969. A variety of melt-forming compounds are useful including, for example, formamide, acetamide, propionamide, 2-pyrrolidione, and 1,3-dimethylurea. The 1,3-dimethylurea is especially useful with the described preferred complexes of silver with nitrogen acids.

A range of concentration of melt-forming compound is useful in the heat developable photographic materials described. A typically useful concentration range of melt-forming compound is about 0.5 to about 2 parts by weight of melt-forming compound per gram of the silver complex. The optimum concentration of melt-forming compound will depend upon the particular heat developable photographic material, desired image, processing conditions and the like.

Spectral sensitizing dyes can be useful in the described elements and compositions of the invention to confer additional sensitivity to the elements and compositions. Useful sensitizing dyes are described, for example, in the *Product Licensing Index,* Volume 92, 1 December 1971, publication 9232, pages 107–110, paragraph XV. An advantage of the heat developable photographic materials according to the invention is that a wider range of spectral sensitizing dyes is useful than with many other heat developable photographic materials. This in part is due to the use of conventional silver halide emulsions in the heat developable materials according to the invention.

A preferred heat developable photographic material according to the invention contains a spectral sensitizing dye selected from the group consisting of anionic cyanine dyes, anionic merocyanine dyes and combinations of these dyes. Examples of especially useful cyanine dyes and merocyanine dyes include:

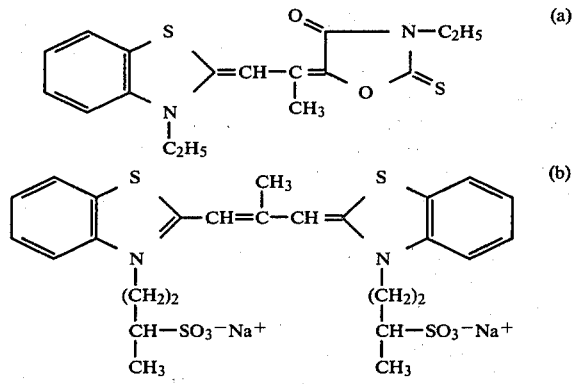

While the optimum concentration of the components of a heat developable photographic material according to the invention will depend upon a variety of factors as described, an especially useful heat developable photographic element according to the invention comprises, for each mole of photographic silver halide, 5 to 20 moles of the described complex and 3 to 15 moles of the described organic reducing agent.

The complex of silver with the described nitrogen acid can contain a range of ratio of the nitrogen acid to silver ion in the complex. The optimum ratio of the nitrogen acid to silver as silver ion will depend upon the particular nitrogen acid, the particular heat developable photographic material, processing conditions and the like. However, the ratio of the nitrogen acid to silver as silver ion in the complex is usefully within the range of 1:1 to 3:1. This ratio of nitrogen acid to silver as silver ion can be determined using methods known in the photographic art. An especially useful ratio of the described nitrogen acid to silver as silver ion is 1.5:1.

The heat developable photographic materials also can contain a range of pAg. The pAg can be measured using conventional calomel and Ag-AgCl electrodes, connected to an Orion digital pH-meter. The typical pAg in a heat developable photographic material according to the invention is within the range of about 2 to about 6, with a preferred range of pAg being 3.5 to 5.5. The optimum pAg will depend upon the described factors, such as the particular heat developable photographic material, desired image, processing conditions and the like.

The heat developable photographic materials according to the invention typically have a pH range which is on the acid side of neutral, that is a pH of less than 7. A typically useful pH for a heat developable photographic material according to the invention is within the range of about 2 to about 6, with the preferred range being about 3.5 to 5.0.

It is desirable to employ a stabilizer or a stabilizer precursor in the described heat developable materials according to the invention to improve post-processing image stability. In some cases the complexes, as described, are stable after processing. However, in the case of photographic silver halide, it can be desirable to stabilize the silver halide after processing in order to avoid post-processing print-out. A variety of stabilizer or stabilizer precursors are useful in a heat developable photographic material as described. The stabilizers or stabilizer precursors can be used alone or in combination. Typical useful stabilizers or stabilizer precursors are azole thioethers and blocked azoline thione stabilizer precursors such as described in Belgian Pat. No. 768,071, issued July 30, 1971, and 4-aryl-1-carbamyl-2-tetrazoline-5-thione stabilizer precursors, such as described in U.S. Pat. No. 3,893,859 of Burness et al, issued July 8, 1975. Other useful stabilizers or stabilizer precursors include those described in U.S. Pat. No. 3,839,041 of Hiller issued Oct. 1, 1974; U.S. Pat. No. 3,844,788 of Burness et al issued Oct. 29, 1974 and U.S. Pat. No. 3,877,940 of Ericson issued Apr. 15, 1975. Photolytically activated polyhalogenated organic compounds can be used, but these compounds have been found to be less desirable than other stabilizers or stabilizer precursors. Such photolytically activated polyhalogenated organic compounds are described, for example, in U.S. Pat. No. 3,874,946 of Costa et al, issued Apr. 1, 1975 and U.S. Pat. No. 3,707,377 of Tiers et al, issued Dec. 28, 1972.

A range of concentration of stabilizer or stabilizer precursor can be useful in the described heat developable materials. An optimum concentration of stabilizer or stabilizer precursor will depend upon such factors as the particular heat developable material, processing conditions, desired stability of image and the like. A typically useful concentration range of stabilizer or stabilizer precursor is about 0.1 to about 20 moles of stabilizer or stabilizer precursor per mole of photographic silver halide in the heat developable material. A preferred concentration of stabilizer or stabilizer precursor is within the range of about 4 to about 8 moles of stabilizer or stabilizer precursor per mole of photographic silver halide in the heat developable material as described.

It is in some cases useful to have a so-called overcoat layer on the heat developable photographic element according to the invention to reduce fingerprinting and abrasion marks. The overcoat layer can be one or more of the described polymers which are also useful as binders. However, other polymeric materials which are compatible with the heat developable layer and can tolerate the processing temperatures employed according to the invention can be useful. Such other binders or polymeric materials include, for instance, cellulose acetate. Combinations of polymeric materials can be useful for overcoat purposes if desired.

The heat developable materials according to the invention can contain other addenda such as development modifiers that function as speed-increasing compounds, hardeners, plasticizers and lubricants, coating aids, brighteners, absorbing and filter dyes, antistatic materials or layers, and the like. These are described, for example, in the *Product Licensing Index,* Volume 92, December 1971, publication 9232, pages 107–110.

The heat developable elements according to the invention can comprise a variety of supports which can tolerate the processing temperatures employed according to the invention. Typical supports include cellulose ester film, poly(vinyl acetal) film, poly(ethylene terephthalate) film, polycarbonate film and polyester film supports as described in U.S. Pat. No. 3,634,089 of Hamb issued July 11, 1972 and U.S. Pat. No. 3,725,070 of Hamb et al issued Apr. 3, 1973. Related film and resinous support materials, as well as glass, paper, metal and the like supports which can withstand the processing temperatures described are also useful. Typically, a flexible support is most useful.

The compositions according to the invention can be coated on a suitable support by various coating procedures known in the photographic art including dip coating, airknife coating, curtain coating or extrusion coating using hoppers such as described in U.S. Pat. No. 3,681,294 of Beguin issued June 15, 1954. If desired, two or more layers can be coated simultaneously such as described in U.S. Pat. No. 2,761,791 of Russell issued Sept. 4, 1956 and British Pat. No. 837,095 published June 9, 1960.

The described components of the heat developable materials according to the invention can be in any suitable location in the heat developable element which provides the desired image. For example, if desired one or more components of the heat developable element according to the invention can be in one or more layers of the element. In some cases, it can be desirable to include certain percentages of the described reducing agents, image stabilizer or stabilizer precursors and/or other addenda in a protective layer over the heat developable element. In some cases this can reduce migration of certain addenda between layers of the described element.

It is necessary that the photosensitive silver halide, as described, and other components in the image-forming combination according to the invention be in reactive association with each other in order to provide the desired image. The term "in reactive association" as employed herein is intended to mean that the photographic silver halide and the image-forming combination are in a location with respect to each other which enables the desired processing and provides a more useful developed image. It is believed that the latent image formed from imagewise exposure of the photosensitive silver halide acts as a catalyst for the image-forming combination containing the complex of silver with the described nitrogen acid.

It is believed that this enables a lower processing temperature for image formation than otherwise would be possible. While the exact nature of the reaction mechanisms and image formation in the developable material according to the invention is not fully understood, it is believed that the reaction is an amplification reaction enabled by the catalytic effect of the latent image silver. Accordingly, the term "in reactive association" is intended to mean that the components are in a location with respect to each other which enable this desired lower processing temperature.

If desired, other heat developable photographic materials can be used in combination with the heat developable photographic materials according to the invention.

The other heat developable photographic materials must be compatible with and not adversely affect the image formation in a heat developable material according to the invention. For example, a heat developable photographic element can comprise respectively a support having thereon a heat developable photographic layer comprising a complex of silver with a nitrogen acid according to the invention and a separate layer containing a different photothermographic material containing photographic silver halide as a component with other necessary imaging materials. An example of such a heat developable material is one containing a layer contiguous to the layer containing the complex of silver with a nitrogen acid and which separate layer contains photographic silver halide in reactive association with a silver salt of certain heterocyclic thione compounds and an organic reducing agent. A useful material containing such a silver salt of certain heterocyclic thione compounds is described in U.S. Pat. No. 3,893,860 of Sutton et al issued July 8, 1975. In some cases the silver salt of the heterocyclic thione compound as described in U.S. Pat. No. 3,893,860, can be used in the same layer as the described complex of silver with a nitrogen acid. The optimum concentrations and ratios of components in such a layer will depend upon the desired image, particular components of the heat developable material, processing conditions and the like.

An especially useful embodiment of the invention is a heat developable photographic element comprising a support having thereon in reactive association (a) a gelatino photosensitive silver halide emulsion, (b) an image-forming combination comprising (i) a complex of silver with dodecyl tetrazole, and (ii) an ascorbic acid developing agent, such as ascorbic acid, (c) a gelatino binder, (d) a toning agent consisting essentially of 5-amino-1,3,4-thiadiazole-2-thiol or 3-mercapto-1,2,4-triazol, and (e) a melt-forming compound consisting essentially of 1,3-dimethylurea.

Another especially useful embodiment of the invention is a heat developable photographic element comprising a support having thereon in reactive association (a) a gelatino photosensitive silver halide emulsion, (b) an image-forming combination comprising (i) a complex of silver with 3-amino-1,2,4-triazole and (ii) a hydroquinone developing agent, (c) a gelatino binder, (d) a toning agent consisting essentially of 5-amino-1,3,4-thiadiazole-2-thiol or 3-mercapto-1,2,4-triazole, and (e) a melt-forming compound consisting essentially of 1,3-dimethylurea.

Various imagewise exposure means are useful with the heat developable materials according to the invention. The materials according to the invention are typically sensitive to the ultraviolet and blue regions of the spectrum and exposure means which provide this radiation are preferred. Typically, however, if a spectral sensitizing dye is employed in the heat developable materials, exposure means using other ranges of the spectrum are useful. Typically, a photosensitive element according to the invention is exposed imagewise with a visible light source such as a tungsten lamp, although other sources of radiation are useful such as lasers, electron beams and the like.

A visible image can be developed in a heat developable material, as described, within a short time after imagewise exposure, merely by uniformly heating the heat developable material to moderately elevated temperatures. For example, the heat developable element can be heated after imagewise exposure to a temperature within the range of about 120° C. to about 180° C. Heating is carried out until a desired image is developed, typically within about 1 to about 90 seconds, such as within about 1 to about 30 seconds. The heat developable material according to the invention is preferably heated to a temperature within the range of about 140° C. to about 165° C. until a desired image is obtained, typically for about 1 to about 30 seconds.

Another embodiment of the invention is a process of developing an image in a heat developable photographic element comprising a support having thereon in reactive association (a) photosensitive silver halide, (b) an image-forming combination comprising (i) a complex of silver with a nitrogen acid, as described, with (ii) an organic reducing agent, also as described, and (c) a polymeric binder, comprising heating the described element to a temperature within the range of about 120° C. to about 180° C. until a desired image is obtained, such as for about 1 to about 30 seconds.

A preferred process is a process of developing an image in a heat developable photographic element comprising a support having thereon in reactive association (a) a gelatino photosensitive silver halide emulsion, (b) an image-forming combination comprising (i) a complex of silver with dodecyl tetrazole, and (ii) an ascorbic acid developing agent, (c) a gelatino binder, (d) a toning agent consisting essentially of 5-amino-1,3,4-thiadiazole-2-thiol or 3-mercapto-1,2,4-triazole, and (e) a melt-forming compound consisting essentially of 1,3-dimethylurea, comprising heating the described element to a temperature within the range of about 140° C. to about 165° C. until a desired image is developed, such as for about 1 to about 30 seconds.

Another especially useful process is a process of developing an image in a heat developable photographic elemnt comprising a support having thereon in reactive association (a) a gelatino photosensitive silver halide emulsion, (b) an image-forming combination comprising (i) a complex of silver with 3-amino-1,2,4-triazole, and (ii) a hydroquinone developing agent, (c) a gelatino binder, (d) a toning agent consisting essentially of 5-amino-1,3,4-thiadiazole-2-thiol or 3-mercapto-1,2,4-triazole, and (e) a melt-forming compound consisting essentially of 1,3-dimethylurea, comprising heating the described element to a temperature within the range of about 140° C. to about 165° C. until a desired image is developed, such as for about 1 to about 30 seconds.

The heat developable materials according to the invention are useful for forming a negative or positive image. The formation of a negative or positive image will depend primarily upon the selection of the particular photosensitive silver halide. One class of useful photosensitive silver halide materials is the class of direct-positive photographic silver halide materials designed to produce positive images. Internal image silver halide emulsions can be used for this purpose, such as those described in U.S. Pat. No. 2,592,250 of Davey et al issued Apr. 8, 1952; U.S. Pat. No. 3,206,313 of Porter et al issued Sept. 14, 1965; U.S. Pat. No. 3,367,778 of Berriman et al issued Feb. 6, 1968; and U.S. Pat. No. 3,447,927 of Bacon et al issued June 3, 1969. If desired mixtures of surface and internal image silver halide emulsions can be used as described in U.S. Pat. No. 2,996,382 of Luckey et al issued Apr. 14, 1961.

Although it is often undesirable, due to the lack of control in preparation, the described photographic silver halide can be prepared in situ in the described material according to the invention. Such a method of preparation of photographic silver halide in situ in a photothermographic material is described, for example, in U.S. Pat. No. 3,457,075 of Morgan et al issued July 22, 1969.

Processing according to the invention is usually carried out under ambient conditions of pressure and humidity. Pressures and humidity outside normal atmospheric conditions can be employed if desired; however, normal atmospheric conditions are preferred.

A variety of means can be employed to provide the necessary heating of the described heat developable materials to provide a developed image. The heating means can be a simple hot plate, iron, roller or the like.

It is desirable in some instances to include a development accelerator in a heat developable photographic material as described. Development accelerator as used herein is intended to include those compounds which increase the rate of development to provide a developed image or lead to increased image density in the resulting image. Compounds which provide these desired properties often are compounds which act as humectants. An example of a heat developable photographic element containing such a development accelerator is: a photographic element containing in reactive association (a) a photographic gelatino silver bromoiodide emulsion, (b) an image-forming combination comprising (i) a complex of silver with 3-amino-1,2,4-triazole (containing a ratio of nitrogen acid to silver as silver ion in the complex of (1:1), with (ii) 2,5-dihydroxyphenylacetic acid as a developing agent, and (c) gelatin as a polymeric binder. In addition, a development accelerator is included in the material at a concentration which provides about 50 milligrams of development accelerator per square foot of support of the photographic element. Compounds which provide a degree of development acceleration in this material are ethylene glycol, triethylene glycol, 1,2-propanediol, dipropylene glycol, 2,2'-oxydiethylenol, tetraethylene glycol, tetrahydrothiophene-1,1-dioxide and acetamide. Of these compounds tetrahydrothiophene-1,1-dioxide is especially useful because it provides minimal loss in incubation stability and tends to provide a reduction in the increase of print-out density upon processing.

The following examples are included for a further understanding of the invention.

EXAMPLE 1—Heat developable material containing complex of silver with 1,2,4-triazole A solution of 5.5 grams of 1,2,4-triazole and 8.0 grams of deionized photographic gelatin in 20 milliliters of a mixture of 90% by volume ethanol and 10% by volume methanol and 80 milliliters of distilled water was prepared. A solution of 13.6 grams of silver nitrate in 100 milliliters of distilled water was added to the resulting solution using a blending procedure. The blending procedure consisted of rapidly adding the silver nitrate solution to the 1,2,4-triazole solution in a jacketed mechanical blender at 110°-120° F. (corresponding to 43° to 49° C.). The mixing speed of the mechanical blender was then slowly increased to provide a rapid mixing action and the mixture was blended at that mixing speed for 45 minutes. The final weight of the composition was 2.5 kilograms per silver mole, the pH was 1.4 and the pAg was 3.1.

The resulting photographic composition was coated on a resin coated paper support using a knife-blade coating procedure to provide a wet coating thickness of 4 mils. The coating preparation for this purpose contained the following composition:

| | |
|---|---|
| dispersion containing complex of silver with 1,2,4-triazole (prepared as described above) | 2.0 ml |
| composition consisting of 1 part by volume of silver bromide gelatino emulsion to 9 parts by volume distilled water | 1.2 ml |
| 10% by weight deionized gelatin | 1.2 ml |
| hydroquinone (5% by weight in water) | 1.7 ml |
| saponin surfactant | 0.2 ml |
| distilled water | 1.7 ml |

The photographic element was imagewise exposed for 20 seconds on a commercial sensitometer to provide a developable latent image. The resulting image was developed by contacting the exposed element on a heated metal block at 150° C. for 10 seconds. A developed image was produced having a green-black color on a light gray background.

The procedure was repeated wherein a portion of the described dispersion containing the complex of silver with 1,2,4-triazole was adjusted to a pH of 6.0 with ammonium hydroxide to provide a pAg of 7.1. A coating formulation identical to that described above was prepared and coated on the described paper support. The resulting photographic element was then imagewise exposed for 20 seconds as described to provide a developable latent image. The resulting image was developed by contacting the exposed element with a heated metal block at 140° C. for 5 seconds. A developed image resulted having a maximum density of 0.87 and a minimal density of 0.27. The image tone of the developed image was brown-black and exhibited 7 visible developed steps on a conventional exposure scale. The coating uniformity and image density was improved as a result of the dispersion pH being adjusted to 6.0.

EXAMPLE 2—Heat developable photograhpic material containing a complex of silver with 3-amino-1,2,4-triazole The procedure described in Example 1 was repeated with the exception that 5.0 grams of 3-amino-1,2,4-triazole was used in place of 1,2,4-triazole. The final pH of the photographic composition was 3.5 and the pAg was 5.0 prior to imagewise exposure.

The composition used for coating contained the following components:

| | |
|---|---|
| dispersion containing the complex of silver with 3-amino-1,2,4-triazole | 2.0 ml |
| silver bromide emulsion (as described in Example 1) | 1.2 ml |
| 5% by weight hydroquinone in water | 1.7 ml |
| 0.5% by weight Surfactant 10G in water (Surfactant 10G is a reaction product | 0.2 ml |

-continued

| | |
|---|---|
| of an alkyl phenol with glycidol and is commercially available from the Olin corporation, U.S.A.) | |
| distilled water | 2.9 ml |

The composition was coated on the described paper support at a wet coating thickness of 4 mils.

The resulting photographic element was imagewise exposed for 20 seconds on a commercially available sensitometer to provide a developable latent image. The resulting image was developed by contacting the photographic element with a metal block at 140° C. for 5 seconds. A developed image was produced having a maximum density of 0.75 and a minimum density of 0.12. The developed image had a brown-black tone with 7 visible density steps.

EXAMPLE 3—Illustration of processing latitude

A heat developable photographic element was prepared as described in Example 2. The resulting photographic element was divided into 6 parts each of which was imagewise exposed for 20 seconds on a commercially available sensitometer to provide a developable latent image. Each element was then heated by contacting the element at the temperature designated in following Table I for 5 seconds. The image developed in each case is described in following Table I.

Table I

| Proc. Temp. | $D_{max}/D_{min}$ | Image Tone | Visible Steps |
|---|---|---|---|
| 140° C. | 0.66/0.12 | Brown | 6 |
| 145° C. | 0.75/0.13 | Brown | 7 |
| 150° C. | 0.75/0.13 | Brown | 7 |
| 155° C. | 0.75/0.18 | Brown | 7 |
| 160° C. | 0.75/0.16 | Brown | 7 |
| 165° C. | 0.75/0.22 | Brown | 7 |

This illustrates that over a 20° C. temperature range, that is between 145° C. and 165° C., neither the maximum density nor the photographic speed significantly changed while only a 0.09 increase in minimum density was produced. It also illustrates no observable change in image tone within this processing temperature range.

EXAMPLE 4—Addition of toning agent

A dispersion was prepared containing a complex of silver with 3-amino-1,2,4-triazole as described in Example 2. A coating formulation was prepared containing the following components:

| | |
|---|---|
| dispersion containing complex of silver with 3-amino-1,2,4-triazole | 2.6 ml |
| silver bromide gelatino emulsion (as described in Example 1) | 0.32 ml |
| 5% by weight hydroquinone in water | 1.7 ml |
| 0.5% by weight Surfactant 10G in water | 0.2 ml |
| distilled water | 2.9 ml |

The described formulation was coated on a paper support as described in Example 1 at a wet coating thickness of 4 mils.

The resulting photographic element was imagewise exposed on a commercially available sensitometer for 20 seconds to provide a developable latent image. The resulting image was developed by contacting the photographic element with a heated metal block at 160° C. for 5 seconds. This produced a developed image having a maximum density of 0.48 and a minimum density of 0.10. The developed image had a brown tone. This was used as a control to compare with photographic elements containing a toning agent.

A coating identical to the above was prepared with the exception that 0.51 milliliters of 3-mercapto-1,2,4-triazole (0.25% by weight in methanol) was added to the coating formulation prior to coating on the paper support and 2.4 milliliters of distilled water was used. The resulting photographic element was imagewise exposed as described above and processed using the same temperature and time also as described. The resulting developed image had a maximum density of 0.78 and a minimum density of 0.10. The image tone of the developed image was black on a white background.

This illustrates that maximum density and image tone were improved by adding the toning agent, 3-mercapto-1,2,4-triazole, to the described photographic element.

EXAMPLE 5—Spectral sensitizers

A dispersion containing a complex of silver with a nitrogen acid was prepared as described in Example 2.

A photographic element was prepared as described in Example 2. The photographic element was imagewise exposed for 20 seconds in a commercially available sensitometer as described in Example 2 to provide a developable latent image. The element was then heated by contacting it with a metal block at a temperature of 140° C. for 5 seconds. A developed image was produced having a maximum density to blue light of 0.98 and a minimum density to blue light of 0.10 with 6 visible steps.

The procedure was repeated with the exception that 0.46 milliliters of a 0.01% by weight aqueous solution of the spectral sensitizing dye represented by the formula:

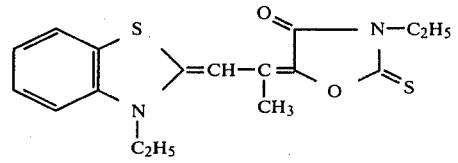

was added to the silver halide emulsion prior to the addition of the remaining described addenda of the photographic composition. The composition as coated on a paper support as described in Example 2. The resulting photographic element was imagewise exposed for 5 seconds in a commercial sensitometer to provide a developable latent image as described above. The image was developed by contacting the element with a metal block at 140° C. for 2 seconds. The resulting developed image had a maximum density to blue light of 1.2 and a minimum density to blue light of 0.3 with 10 visible steps.

This illustrates that the photographic speed or response to white light exposure was doubled by the addition of the described spectral sensitizing dye.

EXAMPLE 6—Heat developable photographic film

The dispersion and coating composition as described in Example 2 were coated at a wet thickness of 7 mils on a gel-subbed pol(ethylene terephthalate) film support. The resulting developable photographic film was imagewise exposed in a commercial sensitometer for $10^{-3}$ seconds to provide a developable latent image. The resulting exposed element was heated for 2 seconds by contacting it with a metal block at a temperature of 160° C. The resulting developed image had a brown-black color and a maximum density of 1.8 with a minimum density of 0.2.

A heat developable photograhic film was prepared as described above with the exception that the photographic layer prior to imagewise exposure was overcoated with the following composition:

| | |
|---|---|
| 10% by weight deionized photographic gelatin in water | 1.7 ml |
| 5% by weight hydroquinone in water | 1.7 ml |
| 0.5% by weight in water of Surfactant 10G | 0.2 ml |
| distilled water | 4.4 ml |

The coating composition was applied at a wet coating thickness of 4 mils. The overcoat was dried at 49° C. (120° F.). The heat developable photographic element was imagewise exposed and the resulting image developed as described above. The resulting developed image had a maximum transmission density of 1.68 and a minimum transmission density of 0.16. The resulting image had improved clarity over the unovercoated material.

EXAMPLE 7—Heat developable material containing a complex of silver with 5-n-propyl-1H-tetrazole A complex of silver was prepared by dissolving 3.36 grams of 5-n-propyl-1H-tetrazole (0.03 moles) in 100 milliliters of distilled water. A solution of 5.10 grams (0.03 moles) of silver nitrate was prepared by dissolving the silver nitrate in 100 milliliters of distilled water. The silver nitrate solution was added, with stirring and under safelight conditions, to the described tetrazole solution. A white precipitate resulted and was filtered with suction and washed well with distilled water followed by washing with acetone. The resulting product was air dried to provide 5.96 grams of a white chunky solid. This solid was analyzed and found it contained 49.1% silver, 25.9% nitrogen, 2.9% hydrogen and 21.8% carbon. The calculated values for $AgC_4H_7N_4$ were 49.4% silver, 25.6% nitrogen, 3.19% hydrogen and 21.9% carbon.

A dispersion was prepared by combining 4.4 grams of the described white solid with 4.0 grams of deionized photographic gelatin in 20 milliliters of a solvent consisting of 90% by volume ethanol and 10% by volume methanol. The resulting composition was brought to a total weight of 100 grams (5 kilograms per mole of silver) with distilled water. The composition was then dispersed by sonic vibration means for 5 minutes in a water jacketed container. The thoroughly mixed material had a final pH of 5.9 and a pAg of 5.9.

A coating composition was prepared by mixing the following components:

| | |
|---|---|
| dispersion containing a complex of silver with 5-n-propyl-1H-tetrazole as described above | 2.0 ml |
| silver bromide emulsion (1 to 10 parts by volume water) | 1.2 ml |
| 5% by weight hydroquinone in water | 1.7 ml |
| 0.5% by weight Surfactant 10G in water | 0.2 ml |
| distilled water | 2.9 ml |

The resulting composition was coated at a wet coating thickness of 4 mils on a paper support. The resulting photographic element was imagewise exposed for 20 seconds with a commercially available sensitometer to provide a developable latent image. The resulting image was developed by contacting the element with a metal block at a temperature of 160° C. for 5 seconds. This provided a developed brown image on an off-white background with 7 visible density steps.

EXAMPLE 8—Heat developable photographic material containing a complex of silver with 5-n-butyl-1H-tetrazole A complex of silver with 5-n-butyl-1H-tetrazole was prepared employing the same procedure for preparation of a complex of silver as described in Example 7 with the exception that 2.52 grams of 5-n-butyl-1H-tetrazole and 3.40 grams of silver nitrate were used in place of the described tetrazole and silver nitrate concentration of Example 7. The yield of the resulting product was 4.43 grams. The product was analyzed and found to contain 46.1% silver, 24.2% nitrogen, 4.1% hydrogen and 25.7% carbon. This corresponded to a calculated amount for $AgC_5H_9N_4$ of 46.4% silver, 24.0% nitrogen, 3.8% hydrogen and 25.8% carbon.

The resulting product was used for preparation of a dispersion as described in Example 7 using 2.33 grams of the described complex of silver with 5-n-butyl-1H-tetrazole. The final pH of the coating composition was 6.0 and the pAg was 5.8.

A heat developable photographic element was prepared by mixing a coating formulation the same as the composition described in Example 7 with the exception that the dispersion contained the complex of silver with 5-n-butyl-1H-tetrazole rather than 5-n-propyl-1H-tetrazole. The resulting heat developable photographic element was imagewise exposed as described in Example 7 and the resulting latent image was developed at the temperature also described in Example 7. The resulting developed image had a red-brown color on a cream colored background with 7 visible density steps.

EXAMPLE 9—Ascorbic acid as a developing agent

A dispersion identical to that described in Example 8 was prepared containing the complex of silver with 5-n-butyl-1H-tetrazole.

A coating composition was prepared by mixing the following components:

| | |
|---|---|
| dispersion containing complex silver with 5-n-butyl-1H-tetrazole | 2.0 ml |
| silver bromide gelatino emulsion (diluted 1:10 parts by weight with water) | 1.2 ml |
| 5% by weight ascorbic acid in water | 1.7 ml |
| 0.5% Surfactant 10G in water | 0.2 ml |
| distilled water | 2.9 ml |

The resulting composition was coated on a paper support at a wet thickness of 4 mils. The heat developable photographic element was then exposed imagewise for 20 seconds on a commercial sensitometer to provide a developable latent image. The resulting latent image was developed by contacting the photographic element with a metal block at a temperature of 160° C. for 5 seconds. A developed image resulted having a red-brown color on a light yellow background with 8 visible density steps.

EXAMPLE 10—Use of melt-forming compound

A heat developable photographic element (control) was prepared identical to that described in Example 9. The heat developable photographic element was imagewise exposed and the resulting latent image developed as described in Example 9. The resulting developed image had a maximum density to blue light of 0.40 and a minimum density to blue light of 0.06. Processing to provide this image was by contacting the element on a heated metal block at 140° C. for 5 seconds.

A composition was prepared containing a melt-forming compound which was 1,3-dimethylurea. The coating composition contained the following components:

| | |
|---|---|
| dispersion containing complex of silver with 5-n-butyl-1H-tetrazole (prepared as described in Example 8) | 2.0 ml |
| silver bromide gelatino emulsion (diluted 1:10 parts by weight with water) | 1.2 ml |
| 5% by weight 1,3-dimethylurea in distilled water | 1.7 ml |
| 0.5% by weight Surfactant 10G in water | 0.2 ml |
| distilled water | 1.2 ml |

The resulting photographic element was imagewise exposed for 20 seconds on a commercial sensitometer to provide a developable latent image. Upon processing, as described, a developed image was produced having a maximum density to blue light of 1.02 and a minimum density to blue light of 0.18. The image was brown in tone with 8 visible density steps.

It was observed that image density was increased when the melt-forming compound 1,3-dimethylurea was added to the heat developable material.

EXAMPLE 11—Reversal photographic silver halide emulsion in the heat developable material A dispersion containing a complex of silver with 5-n-butyl-1H-tetrazole was prepared identical to that described in Example 8. A photographic composition was prepared by mixing the following components:

| | |
|---|---|
| dispersion containing complex of silver with 5-n-butyl-1H-tetrazole | 2.0 ml |
| photographic silver bromoiodide emulsion designed for providing reversal images (silver bromoiodide gelatino emulsion which was surface chemically sensitized with reduction and gold chemical sensitization and contained iridium internal latent image sites) (diluted 1:5 parts by weight with water) | 1.8 ml |
| 5% by weight ascorbic acid in water | 1.7 ml |
| 5% by weight 1,3-dimethylurea in water | 1.7 ml |
| 0.5% by weight Surfactant 10G in water | 0.2 ml |
| distilled water | 0.6 ml |

The resulting composition was coated on a paper support at a wet thickness of 4 mils. The resulting heat developable photographic element was imagewise exposed for 10 seconds on a commercially available sensitometer to provide a heat developable latent image. The resulting latent image was developed by contacting the photographic element with a metal block at a temperature of 150° C. for 5 seconds. A distinct reversal image was developed. The image was white on a brown-black background. The developed image had 7 visible density steps in the image area.

EXAMPLE 12—Stabilizer precursor in a heat developable material

A dispersion was prepared containing a complex of silver with 3-amino-1,2,4-triazole. The ratio of silver as silver ion to the 1,2,4-triazole was 1:1.

A photographic composition was prepared by mixing the following components:

| | |
|---|---|
| dispersion containing the complex of silver with 3-amino-1,2,4-triazole (the dispersion contained 1.0 kilograms of deionized photographic gelatin per mole of silver) | 2.0 ml |
| silver bromoiodide gelatino emulsion (containing 1.79 kilograms of emulsion per mole of silver:diluted 1:5 parts by weight with water) | 0.7 ml |
| 5% by weight hydroquinone in water | 1.7 ml |
| 0.5% Surfactant 10G in water | 0.2 ml |
| distilled water | 3.4 ml |

The photographic composition was coated at a wet thickness of 4 mils on a paper support. This provided a heat developable photographic element. This was used as a control.

A heat developable photographic material was prepared in the same manner as described with the exception that the photographic composition prior to coating on the paper support contained 3.1 ml of an aqueous solution containing 5% by weight of the stabilizer precursor, β-hydroxyethyl isothiouronium trichloroacetate and contained 0.28 milliliters of distilled water. The resulting photographic composition containing the trichloroacetate compound was also coated at a wet thickness of 4 mils on a paper support.

Both the control photographic element and the photographic element containing the trichloroacetate compound were imagewise exposed in a commercially available sensitometer for 20 seconds to provide a developable latent image. Both photographic materials were then developed by contacting the element with a heated metal block at 140°–165° C. for 30 seconds. The densities of the resulting developed images were analyzed and the resulting photographic materials were then placed in a container for 24 hours and exposed to 130 foot-candles of illumination during this period. After this time, the densities of the image were again read with a densitometer. The results obtained are given in the following Table II.

Table II

| | Control | | | | With Isothiuronium Salt | | | |
|---|---|---|---|---|---|---|---|---|
| | Fresh | | 24 hr. | | Fresh | | 24 hr. | |
| Temp. | D-max | D-min | D-max | D-min | D-max | D-min | D-max | D-min |
| 140° C. | 1.52 | 0.30 | 1.49 | 1.68 | 1.67 | 0.22 | 1.47 | 0.68 |
| 145° C. | 1.49 | 0.31 | 1.50 | 1.63 | 1.67 | 0.19 | 1.45 | 0.63 |
| 150° C. | 1.45 | 0.31 | 1.52 | 1.64 | 1.67 | 0.29 | 1.44 | 0.55 |
| 155° C. | 1.44 | 0.32 | 1.54 | 1.61 | 1.66 | 0.34 | 1.41 | 0.51 |
| 160° C. | 1.40 | 0.32 | 1.53 | 1.61 | 1.60 | 0.40 | 1.39 | 0.47 |
| 165° C. | 0.95 | 0.30 | 1.52 | 1.59 | 0.97 | 0.62 | 0.98 | 0.40 |

The above table indicates that the photographic material containing the isothiuronium salt provides diminished print-out densities without a severe loss in maximum density of the developed image.

Isothiuronium stabilizer precursors which are useful for the heat developable photographic materials as described are illustrated by those compounds described in U.S. Pat. No. 3,301,678 of Humphlett et al issued Jan. 31, 1967.

EXAMPLE 13—Toning agents in heat developable materials containing complexes of silver with dodecyl tetrazole A heat developable photographic element was prepared similar to that described in the prior Example 8 relating to the complex of silver with dodecyl tetrazole. The heat developable photographic element contained 5.5 milligrams per square decimeter of silver from the complex of silver with dodecyl tetrazole; 1.1 milligrams per square decimeter of silver as silver bromoiodide (silver bromoiodide gelatino emulsion containing 3 mole % iodide); 10.1 milligrams per square decimeter of ascorbic acid; 10.1 milligrams per square decimeter of 1,3-dimethylurea; 0.1 milligrams per square decimeter of the toning agent listed in the following Table III; and 10.1 milligrams per square decimeter of diionized photographic gelatin with a minor concentration of Surfactant 10 G. The resulting heat developable photographic element was imagewise exposed to light in a commercial sensitometer to provide a developable latent image. The resulting image was developed by contacting the photographic element with a metal block at a temperature of 155° C. for 3 seconds. The resulting image had a maximum and minimum density value as listed in following Table III. The difference between the maximum density to visible light and the maximum density to blue light is listed in Column B of Table III. The most useful toning agents were considered to be those which provided a ratio of maximum density to visible light compared to maximum density to blue light exceeding a value of 0.87. Compounds which did not have this value are considered as comparative examples.

EXAMPLE 14—Comparative example with the silver salt of silver benzotriazole

The procedure described in Example 1 was repeated with the exception that 4.8 g of benzotriazole and 8.0 g deionized photographic gelatin in 50 ml of a mixture of 90% by volume ethanol and 10% by volume methanol and 75 ml distilled water was prepared. To this was added using a blending procedure 6.8 g of $AgNO_3$ in 50 ml distilled water. The final pH of the dispersion was 1.2 and the pAg 2.6.

The coating composition contained the following components:

| | |
|---|---|
| dispersion containing the complex of silver with benzotriazole | 2.0 ml |
| silver bromide emulsion (described in Example 1) | 1.2 ml |
| 5% by weight hydroquinone in water | 1.7 ml |
| 0.5% by weight Surfactant 10G in water | 0.2 ml |
| distilled water | 2.9 |

The above composition was coated on the described paper support at a wet coating thickness of 4 mils.

The photographic composition was imagewise exposed for 20 seconds on a commercially available sensitometer to provide a developable latent image.

A dispersion of 3-amino-1,2,4-triazole was prepared as in Example 2 with the exception that 3.4 g of 3-amino-1,2,4-triazole and 6.8 g $AgNO_3$ was used. The final pH was 1.8 and the pAg 1.9. The weight of dispersion was 5.0 Kg/Ag mole.

The coating composition was identical to that prepared in Example 2. The imagewise exposure was the same as given above for the photographic composition containing the silver complex of benzotriazole.

The resulting images were developed by contacting the exposed element with heated metal blocks set at the temperatures given in Table IV for a period of 5 or 2

Table III

| | 155° C./ 3 sec Process | | | |
|---|---|---|---|---|
| | (A) $D_{max}/D_{min}$ | | (B) | (C) |
| Compound | Visual | blue-light | $D^V_{max}/D^b_{max}$ | Comment |
| Control (no toner) | 0.59/0.05 | 1.08/0.09 | 0.55 | reddish brown |
| Thiourea | 0.86/0.68 | 1.19/1.04 | 0.72 | dark brown-fog |
| Thioacetanilide | 0.26/0.23 | 0.35/0.31 | 0.74 | no image-fog |
| Thioacetamide | 0.91/0.57 | 1.02/0.81 | 0.89 | blue-black-fog |
| Thiosemicarbazide | 1.21/0.91 | 1.42/1.13 | 0.85 | brown-black-fog |
| Dithiooxamide | 1.10 | 1.33 | 0.83 | no image |
| Potassium Ethylxanthate | 0.17/0.15 | 0.30/0.26 | 0.57 | no image-fog |
| Bis(dimethylthiocarbamyl)disulfide | 1.10/0.58 | 1.21/0.68 | 0.91 | black |
| 3-Mercaptopropionic acid | 1.10/0.07 | 1.29/0.10 | 0.85 | brown |
| O-Mercaptobenzoic acid | 0.73/0.06 | 1.01/0.12 | 0.72 | red brown |
| 2-Mercaptopyrimidine | 0.89/0.08 | 1.19/0.13 | 0.75 | brown |
| 2-Thioimidazole | 1.07/0.92 | 1.20/1.04 | 0.89 | grey black |
| 1-Methylimidazoline-2-thione | 0.98/0.58 | 1.16/0.80 | 0.85 | brown black-fog |
| L-Thiazolidine-4-carboxylic acid | 0.98/0.16 | 1.22/0.28 | 0.80 | green-black |
| 2-Benzimidazolethiol | 0.87/0.11 | 1.02/0.19 | 0.85 | light brown |
| 2-Benzothiazolethiol | 0.28/0.05 | 0.42/0.08 | 0.67 | light grey |
| Rhodanine | 0.94/1.05 | 1.16/1.21 | 0.81 | brown-black-fog |
| 2-Thiohydantoin | 0.78/0.24 | 1.04/0.42 | 0.75 | brown |
| 6-Methyl-2-thiouracil | 0.92/6.07 | 1.15/0.10 | 0.80 | brown |
| 3-Mercapto-1,2,4-traizole | 1.12/0.12 | 1.22/0.18 | 0.92 | brown black |
| 5-Amino-1,3,4-thiadiazole-2-thiol | 1.21/0.12 | 1.29/0.18 | 0.94 | black |
| 2,5-Dimercapto-1,3,4-thiadiazole | 0.25/0.05 | 0.58/0.08 | 0.43 | orange-brown |
| Dithiourazole | 0.67/0.05 | 1.16/0.08 | 0.58 | red brown |
| 2-Mercapto-5-phenyl-oxadiazole | 0.17/0.05 | 0.22/0.08 | 0.77 | light grey |
| 1-Phenyl-5-mercaptotetrazole | 0.40/0.05 | 0.54/0.10 | 0.74 | grey |
| Lead Acetate | 0.69/0.06 | 1.18/0.10 | 0.59 | reddish brown |

seconds. The resulting blue-light densities are listed in Table IV.

Table IV

| Processing Temperature (°C.) | Benzotriazole Complex (Processing Time 5 sec.) | | 3-Amino-1,2,4-triazole Complex (Processing Time 2 sec.) | |
|---|---|---|---|---|
| | D-max | D-min | D-max | D-min |
| 140 | 0 | 0 | 1.15 | 0.06 |
| 145 | 0.20 | 0.14 | 1.08 | 0.06 |
| 150 | 0.23 | 0.15 | 1.08 | 0.08 |
| 155 | 0.31 | 0.15 | 1.17 | 0.10 |
| 160 | 0.29 | 0.15 | 1.05 | 0.12 |
| 165 | 0.43 | 0.13 | 1.05 | 0.14 |

The above table demonstrates the greater densities obtainable from the composition containing the silver complex of 3-amino-1,2,4-triazole in less than half the processing time as compared to the silver complex of benzotriazole.

The invention has been described in detail with particular reference to preferred embodiments thereof, but it will be understood that variations and modifications can be effected within the spirit and scope of the invention.

What is claimed is:

1. In a heat-developable, photographic element comprising a support having thereon in a polymeric binder and in reactive association (a) photosensitive silver halide, and (b) an image-forming combination comprising (i) a complex of silver with a nitrogen acid, with (ii) an organic reducing agent, the improvement wherein said nitrogen acid of said complex is a nitrogen acid selected from the group consisting of imidazole, pyrazole, urazole, 1,2,4-triazole and 1H-tetrazole nitrogen acids and combinations thereof.

2. A heat-developable, photographic element as in claim 1 wherein said photosensitive silver halide is a gelatino photographic silver halide emulsion.

3. A heat-developable, photographic element as in claim 1 wherein said organic reducing agent is selected from the group consisting of hydroquinone, ascorbic acid, pyrogallol, gallic acid ester, and phenylenediamine silver halide developing agents and combinations thereof.

4. A heat-developable, photographic element as in claim 1 wherein said polymeric binder is a gelatino binder.

5. A heat-developable, photographic element as in claim 1 also comprising a toning agent.

6. A heat-developable, photographic element as in claim 1 also comprising a toning agent selected from the group consisting of 1,2,4-triazole, 1H-tetrazole, thiouracil and 1,3,4-thiadiazole toning agents.

7. A heat-developable, photographic element as in claim 1 also comprising a 5-amino-1,3,4-thiadiazole-2-thiol toning agent.

8. A heat-developable, photographic element as in claim 1 also comprising a 3-mercapto-1,2,4-triazole toning agent.

9. A heat-developable, photographic element as in claim 1 also comprising a bis(dimethylthiocarbamyl) disulfide toning agent.

10. A heat-developable, photographic element as in claim 1 also comprising a separate melt-forming compound.

11. A heat-developable, photographic element as in claim 1 also comprising a separate melt-forming compound consisting essentially of 1,3-dimethylurea.

12. A heat-developable, photographic element as in claim 1 also comprising a spectral sensitizing dye selected from the group consisting of anionic cyanine dyes, anionic merocyanine dyes and combinations of said dyes.

13. A heat-developable, photographic element as in claim 1 comprising for each mole of said photographic silver halide, 5 to 20 moles of said complex and 3 to 15 moles of said organic reducing agent.

14. A heat-developable, photographic element as in claim 1 wherein the ratio of said nitrogen acid to silver as silver ion in said complex is within the range of 1:1 to 3:1 and pAg in said element is within the range of 2 to 6.

15. In a heat-developable, photographic composition comprising in a polymeric binder and in reactive association:

(a) photosensitive silver halide, and (b) an image-forming combination comprising (i) a complex of silver with a nitrogen acid, with (ii) an organic reducing agent, the improvement wherein said nitrogen acid of said complex is a nitrogen acid selected from the group consisting of imidazole, pyrazole, urazole, 1,2,4-triazole and 1H-tetrazole nitrogen acids and combinations thereof.

16. A heat-developable, photographic composition as in claim 15 wherein said photosensitive silver halide is a gelatino photographic silver halide emulsion.

17. A heat-developable, photographic composition as in claim 15 wherein said organic reducing agent is selected from the group consisting of hydroquinone, ascorbic acid, pyrogallol, gallic acid esters, and phenylenediamine silver halide developing agents, and combinations thereof.

18. A heat-developable, photographic composition as in claim 15 wherein said polymeric binder is a gelatino binder.

19. A heat-developable, photographic composition as in claim 15 also comprising a toning agent.

20. A heat-developable, photographic composition as in claim 15 also comprising a toning agent selected from the group consisting of 1,2,4-triazole, 1H-tetrazole, thiouracil and 1,3,4-thiadiazole toning agents.

21. A heat-developable, photographic composition as in claim 15 also comprising a 5-amino-1,3,4-thiadiazole-2-thiol toning agent.

22. A heat-developable, photographic composition as in claim 15 also comprising a 3-mercapto-1,2,4-triazole toning agent.

23. A heat-developable, photographic composition as in claim 15 also comprising a bis(dimethylthiocarbamyl) disulfide toning agent.

24. A heat-developable, photographic composition as in claim 15 also comprising a separate melt-forming compound.

25. A heat-developable, photographic composition as in claim 15 also comprising 1,3-dimethylurea at a separate melt-forming compound.

26. A heat-developable, photographic composition as in claim 15 also comprising a spectral sensitizing dye selected from the group consisting of anionic cyanine dyes, anionic merocyanine dyes, and combinations of said dyes.

27. A heat-developable, photographic composition as in claim 15 comprising for each mole of said photographic silver halide, 5 to 20 moles of said complex and 3 to 15 moles of said organic reducing agent.

28. A process of developing an image in an exposed heat-developable, photographic element comprising a support having thereon in reactive association (a) photosensitive silver halide, (b) an image forming combination comprising (i) a complex of silver with a nitrogen acid selected from the group consisting of imidazole, pyrazole, urazole, 1,2,4-triazole and 1H-tetrazole nitrogen acid and combinations thereof with (ii) an organic reducing agent, and (c) a polymeric binder, comprising heating said element to a temperature within the range of about 120° C. to about 180° C. until said image is developed.

29. A process as in claim 28 comprising heating said element to a temperature within the range of about 120° C. to about 180° C. for about 1 to about 30 seconds.

30. A process as in claim 28 wherein said complex of silver with a nitrogen acid is represented by the formula

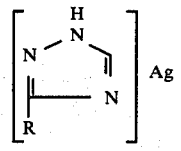

wherein R is hydrogen or $NH_2$; and wherein the ratio of said nitrogen acid to silver as silver ion in said complex is within the range of 1:1 to 3:1.

31. A process as in claim 28 wherein said complex of silver with a nitrogen acid is represented by the formula

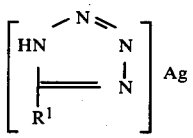

wherein $R^1$ is hydrogen, alkyl containing 1 to 20 carbon atoms, or $NH_2$; and wherein the ratio of said nitrogen acid to silver as silver ion in said complex is within the range of 1:1 to 3:1.

32. In a heat-developable, photographic element comprising a support having thereon in a polymeric binder and in reactive association (a) photosensitive silver halide, and (b) an image-forming combination comprising (i) a complex of silver with a nitrogen acid, with (ii) an organic reducing agent, the improvement wherein said complex of silver with a nitrogen acid is represented by the formula:

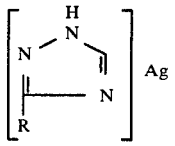

wherein R is hydrogen or $NH_2$; and wherein the ratio of said nitrogen acid to silver as silver ion in said complex is within the range of 1:1 to 3:1.

33. In a heat-developable, photographic element comprising a support having thereon in a polymeric binder and in reactive association (a) photosensitive silver halide, and (b) an image-forming combination comprising (i) a complex of silver with a nitrogen acid, with (ii) an organic reducing agent, the improvement wherein said complex of silver with a nitrogen acid is represented by the formula:

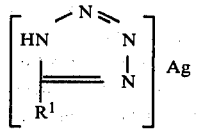

wherein $R^1$ is hydrogen, alkyl containing 1 to 20 carbon atoms, or $NH_2$; and wherein the ratio of said nitrogen acid to silver as silver ion in said complex is within the range of 1:1 to 3:1.

34. In a heat-developable, photographic composition comprising in a polymeric binder and in reactive association (a) photosensitive silver halide, and (b) an image-forming combination comprising (i) a complex of silver with a nitrogen acid, with (ii) an organic reducing agent, the improvement wherein said complex of silver with a nitrogen acid is represented by the formula:

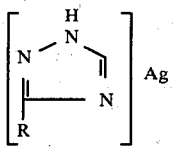

wherein R is hydrogen or $NH_2$; and wherein the ratio of said nitrogen acid to silver as silver ion in said complex is within the range of 1:1 to 3:1.

35. In a heat-developable, photographic composition comprising in a polymeric binder and in reactive association (a) photosensitive silver halide, and (b) an image-forming combination comprising (i) a complex of silver with a nitrogen acid, with (ii) an organic reducing agent, the improvement wherein said complex of silver with a nitrogen acid is represented by the formula:

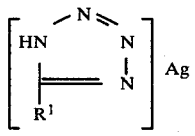

wherein $R^1$ is hydrogen, alkyl containing 1 to 20 carbon atoms, or $NH_2$; and wherein the ratio of said nitrogen acid to silver as silver ion in said complex is within the range of 1:1 to 3:1.

36. A process of developing an image in an exposed heat-developable, photographic element comprising a support having thereon in reactive association (a) a gelatino photosensitive silver halide emulsion,
(b) an image-forming combination comprising
(i) a silver salt of dodecyltetrazole, and
(ii) an ascorbic acid developing agent,
(c) a gelatino binder,
(d) a toning agent consisting essentially of 5-amino-1,3,4-thiadiazole-2-diol or 3-mercapto-1,2,4-triazole, and
(e) a melt-forming compound consisting essentially of 1,3-dimethylurea, comprising heating said element to a temperature within the range of about 140° C. to about 165° C. until said image is developed.

37. A process of developing an image in an exposed heat-developable, photographic element comprising a support having thereon in reactive association
(a) a gelatino photosensitive silver halide emulsion,
(b) an image-forming combination comprising
(i) a complex of silver with 3-amino-1,2,4-triazole, and
(ii) a hydroquinone developing agent,
(c) a gelatino binder,
(d) a toning agent consisting essentially of 5-amino-1,3,4-thiadiazole-2-thiol or 3-mercapto-1,2,4-triazole, and
(e) a melt-forming compound consisting essentially of 1,3-dimethylurea, comprising heating said element to a temperature within the range of about 140° C. to about 165° C. until said image is developed.

38. A heat-developable, photographic element comprising a support having thereon in reactive association
(a) a gelatino photosensitive silver halide emulsion,
(b) an image forming combination comprising
(i) a complex of silver with dodecyltetrazole, and
(ii) an ascorbic acid developing agent,
(c) a gelatino binder,
(d) a toning agent consisting essentially of 5-amino-1,3,4-thiadiazole-2-thiol or 3-mercapto-1,2,4-triazole, and
(e) a melt-forming compound consisting essentially of 1,3-dimethylurea.

39. A heat-developable, photographic element comprising a support having thereon in reactive association
(a) a gelatino photosensitive silver halide emulsion,
(b) an image-forming combination comprising
(i) a complex of silver with 3-amino-1,2,4-triazole, and
(ii) a hydroquinone developing agent,
(c) a gelatino binder,
(d) a toning agent consisting essentially of 5-amino-1,3,4-thiadiazole-2-thiol or 3-mercapto 1,2,4-triazole, and
(e) a melt-forming compound consisting essentially of 1,3-dimethylurea.

40. A heat-developable, photographic composition comprising in reactive association
(a) a gelatino photosensitive silver halide emulsion,
(b) an image forming combination comprising
(i) a complex of silver with dodecyltetrazole, and
(ii) an ascorbic acid developing agent,
(c) a gelatino binder,
(d) a toning agent consisting essentially of 5-amino-1,3,4-thiadiazole-2-thiol or 3-mercapto-1,2,4-triazole, and
(e) a melt-forming compound consisting essentially of 1,3-dimethylurea.

41. A heat-developable, photographic composition comprising in reactive association
(a) a gelatino photosensitive silver halide emulsion,
(b) an image-forming combination comprising
(i) a complex of silver with 3-amino-1,2,4-triazole, and
(ii) a hydroquinone developing agent,
(c) a gelatino binder,
(d) a toning agent consisting essentially of 5-amino-1,3,4-thiadiazole-2-thiol or 3-mercapto-1,2,4-triazole, and
(e) a melt-forming compound consisting essentially of 1,3-dimethylurea.

* * * * *

UNITED STATES PATENT AND TRADEMARK OFFICE

CERTIFICATE OF CORRECTION

PATENT NO. : 4,220,709

DATED : September 2, 1980

INVENTOR(S) : Richard A. deMauriac

It is certified that error appears in the above-identified patent and that said Letters Patent are hereby corrected as shown below:

Column 6, line 13, "1-phenyl-3-pyrazlidinone" should read --- 1-phenyl-3-pyrazolidinone ---.

Column 8, line 14, after "Volume 92," the "I" should be deleted.

Column 11, line 48, "triazol" should read ---triazole---.

Column 12, line 47, "elemnt" should read ---element---.

Column 14, line 51, "photograhpic" should read ---photographic---.

Column 16, line 48, "composition as" should read ---composition was---.

Column 17, line 6, "photograhic" should read ---photographic---.

UNITED STATES PATENT AND TRADEMARK OFFICE

CERTIFICATE OF CORRECTION

PATENT NO. : 4,220,709

DATED : September 2, 1980

INVENTOR(S) : Richard A. deMauriac

It is certified that error appears in the above-identified patent and that said Letters Patent are hereby corrected as shown below:

Column 19, line 61, after "wet" insert ---coating---.

Column 21, Table III, line 20 under the column entitled Compound, "3-Mercapto-1,2,4-traizole" should read --- 3-Mercapto-1,2,4-triazole ---.

Column 22, line 20, "2.9" should read ---2.9 ml---.

Signed and Sealed this

Sixteenth Day of December 1980

[SEAL]

Attest:

SIDNEY A. DIAMOND

Attesting Officer

Commissioner of Patents and Trademarks